US010865978B2

(12) United States Patent
Engelmann

(10) Patent No.: US 10,865,978 B2
(45) Date of Patent: Dec. 15, 2020

(54) LIGHTING SYSTEM

(71) Applicant: Christian Engelmann, Düsseldorf (DE)

(72) Inventor: Christian Engelmann, Düsseldorf (DE)

( * ) Notice: Subject to any disclaimer, the term of this patent is extended or adjusted under 35 U.S.C. 154(b) by 0 days.

(21) Appl. No.: 15/779,401

(22) PCT Filed: Nov. 25, 2016

(86) PCT No.: PCT/EP2016/078872
§ 371 (c)(1),
(2) Date: May 25, 2018

(87) PCT Pub. No.: WO2017/089578
PCT Pub. Date: Jun. 1, 2017

(65) Prior Publication Data

US 2018/0313527 A1 Nov. 1, 2018

(30) Foreign Application Priority Data

Nov. 26, 2015 (DE) ..... 10 2015 120 490

(51) Int. Cl.
*F21V 29/77* (2015.01)
*F21V 19/00* (2006.01)
(Continued)

(52) U.S. Cl.
CPC ..... *F21V 29/773* (2015.01); *F21V 19/003* (2013.01); *F21V 19/0045* (2013.01);
(Continued)

(58) Field of Classification Search
CPC ..... F21V 29/503; F21V 29/773; F21V 19/00; F21V 19/003; F21V 19/0045; F21V 23/002; F21V 23/06; F21Y 2115/10
See application file for complete search history.

(56) References Cited

U.S. PATENT DOCUMENTS 7,322,718 B2 * 1/2008 Setomoto ..... H05B 33/0803 362/276
9,062,857 B2 6/2015 Moon et al.
(Continued)

FOREIGN PATENT DOCUMENTS

CN 103097814 A 6/2013
CN 1464953 12/2013
(Continued)

OTHER PUBLICATIONS

Int'l Preliminary Report on Patentability dated May 29, 2018 in Int'l Application No. PCT/EP2016/078872.
(Continued)

*Primary Examiner* — Mary Ellen Bowman
(74) *Attorney, Agent, or Firm* — Panitch Schwarze Belisario & Nadel LLP

(57) ABSTRACT

A lighting system, in particular in the form of a lamp, may have at least one cooling element, wherein the cooling element has at least a first recess, in particular in the form of a groove which forms a first module holder for at least one LED module. The at least one LED module lies in or can be inserted into the first recess, wherein the first recess has a base wall and limiting lateral walls. The LED module which lies in the first recess can be pushed or is being pushed in the direction of the base wall by at least one of the lateral walls or a part which can be fixed or locked to the cooling element.

28 Claims, 9 Drawing Sheets

Figure 1:
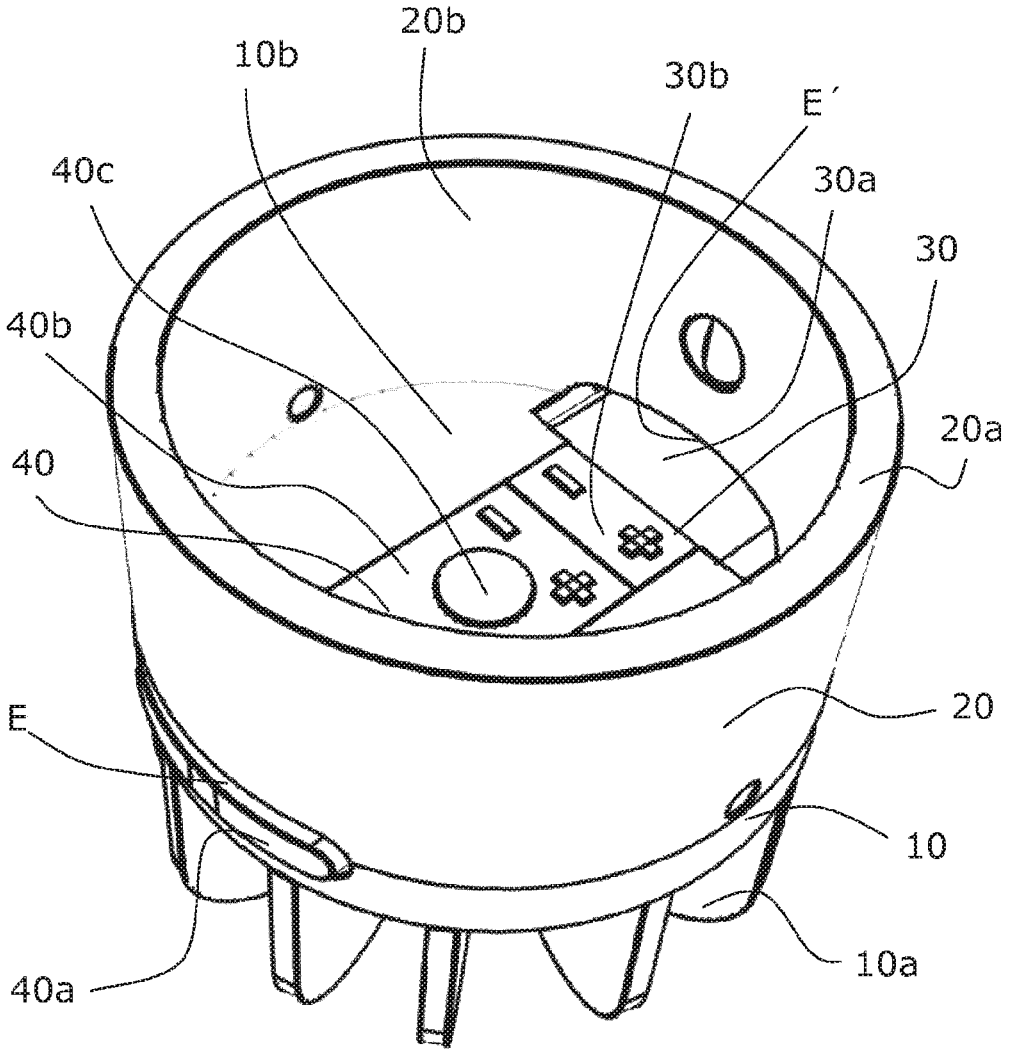

(51) Int. Cl.

| | |
|---|---|
| ***F21V 29/503*** | (2015.01) |
| ***F21V 23/00*** | (2015.01) |
| ***F21V 23/06*** | (2006.01) |
| ***F21Y 115/10*** | (2016.01) |

(52) U.S. Cl.

CPC ..... *F21V 23/002* (2013.01); *F21V 23/06* (2013.01); *F21V 29/503* (2015.01); *F21Y 2115/10* (2016.08)

(56) References Cited

U.S. PATENT DOCUMENTS

| | | | | |
|---|---|---|---|---|
| 9,373,922 | B2 * | 6/2016 | Shimoji | H01R 31/06 |
| 2005/0207165 | A1 * | 9/2005 | Shimizu | F21L 4/00 362/362 |
| 2006/0262545 | A1 | 11/2006 | Piepgras et al. | |
| 2007/0047229 | A1 * | 3/2007 | Lee | F21V 5/04 362/237 |
| 2008/0175003 | A1 * | 7/2008 | Tsou | F21V 17/12 362/294 |
| 2009/0244909 | A1 | 10/2009 | Chen | |
| 2010/0025721 | A1 | 2/2010 | Sakai et al. | |
| 2010/0072505 | A1 * | 3/2010 | Gingrich, III | F21K 9/00 257/99 |
| 2010/0103675 | A1 * | 4/2010 | Yu | F21V 29/773 362/253 |
| 2011/0176308 | A1 * | 7/2011 | Wu | F21S 4/28 362/247 |
| 2012/0033429 | A1 | 2/2012 | Van De Ven | |
| 2012/0218757 | A1 * | 8/2012 | Gill | F21V 15/015 362/235 |
| 2013/0070454 | A1 * | 3/2013 | Zeng | F21V 29/773 362/235 |
| 2014/0140074 | A1 | 5/2014 | Chen et al. | |
| 2015/0267899 | A1 | 9/2015 | Baright | |

FOREIGN PATENT DOCUMENTS

| | | | |
|---|---|---|---|
| DE | 202008011979 | U1 | 12/2008 |
| EP | 1590996 | B1 | 7/2010 |
| EP | 2719938 | A1 | 4/2014 |
| EP | 2728250 | A2 | 5/2014 |
| WO | 2011099288 | A1 | 8/2011 |
| WO | 2014155247 | A1 | 10/2014 |

OTHER PUBLICATIONS

Int'l Search Report dated Apr. 10, 2017 in Int'l Application No. PCT/EP2016/078872.

Written Opinion dated Apr. 10, 2017 in Int'l Application No. PCT/EP2016/078872.

Office Action dated May 14, 2020 in European Application No. 16801493.4.

Office Action dated Mar. 19, 2020 in Chinese Application No. 201680069199.0.

Office Action dated Feb. 24, 2020 in Canadian Application No. 3,006,393.

* cited by examiner

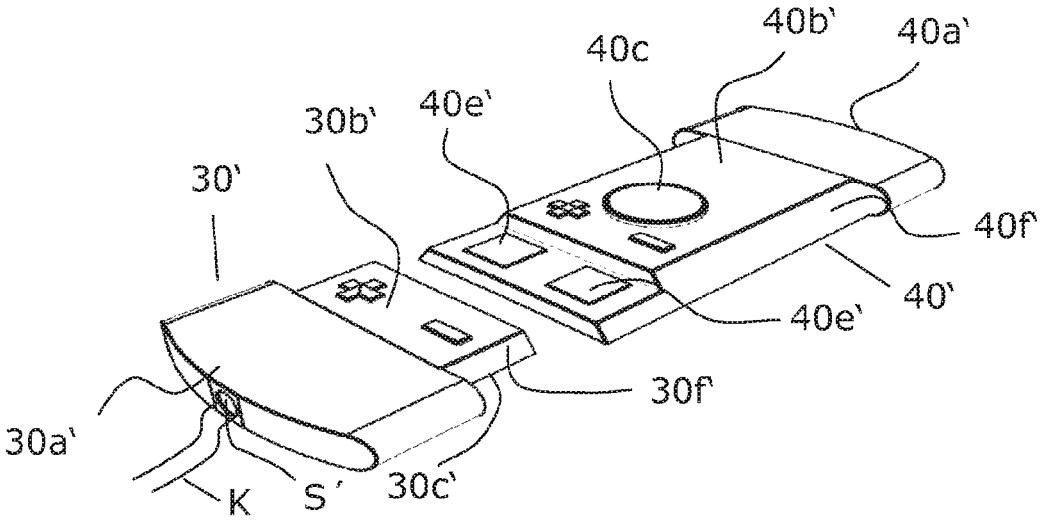
Fig. 4
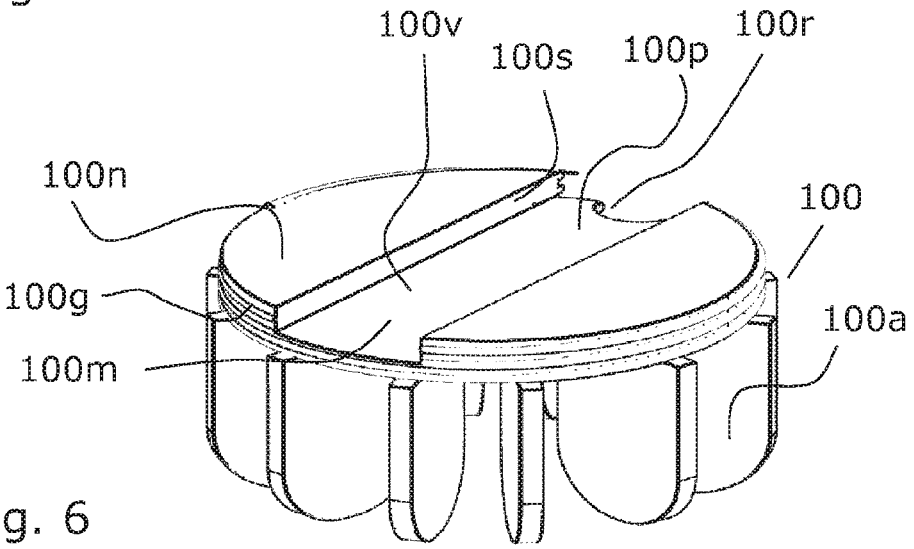
Fig. 6
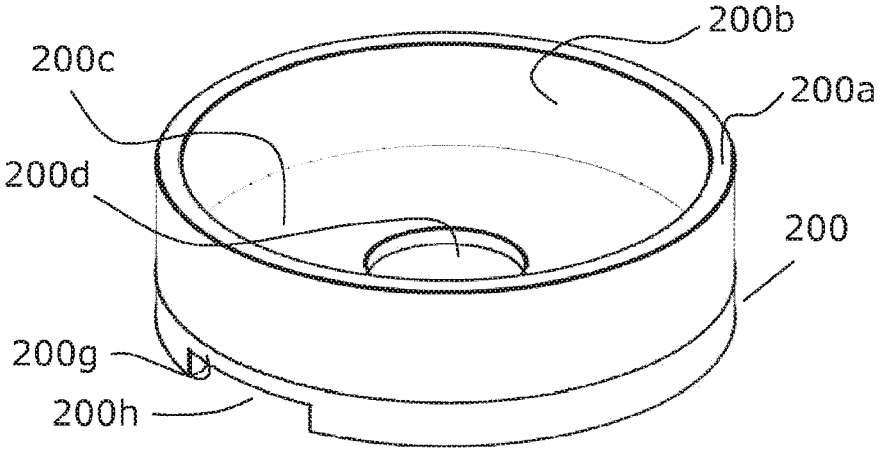

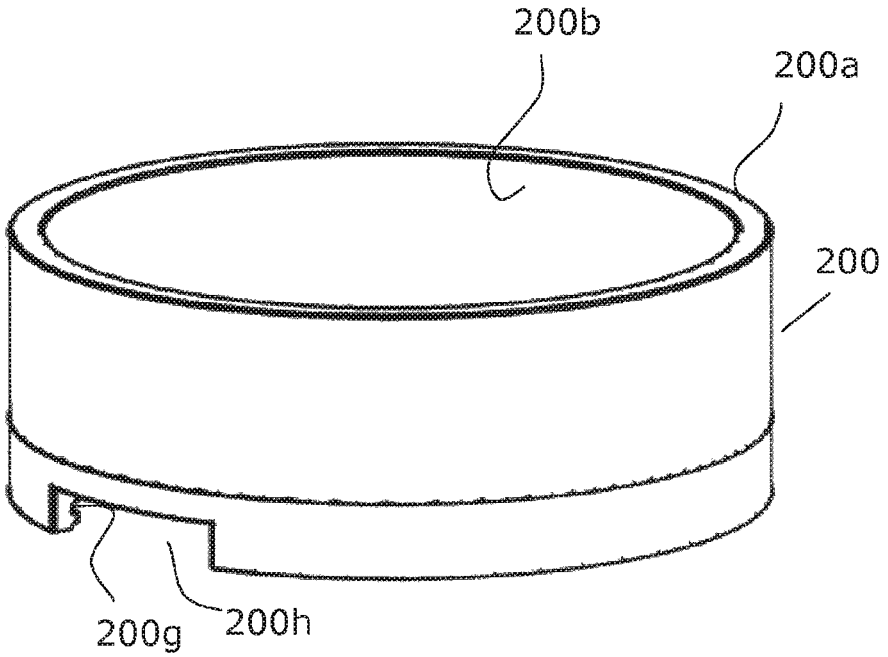
Fig. 5
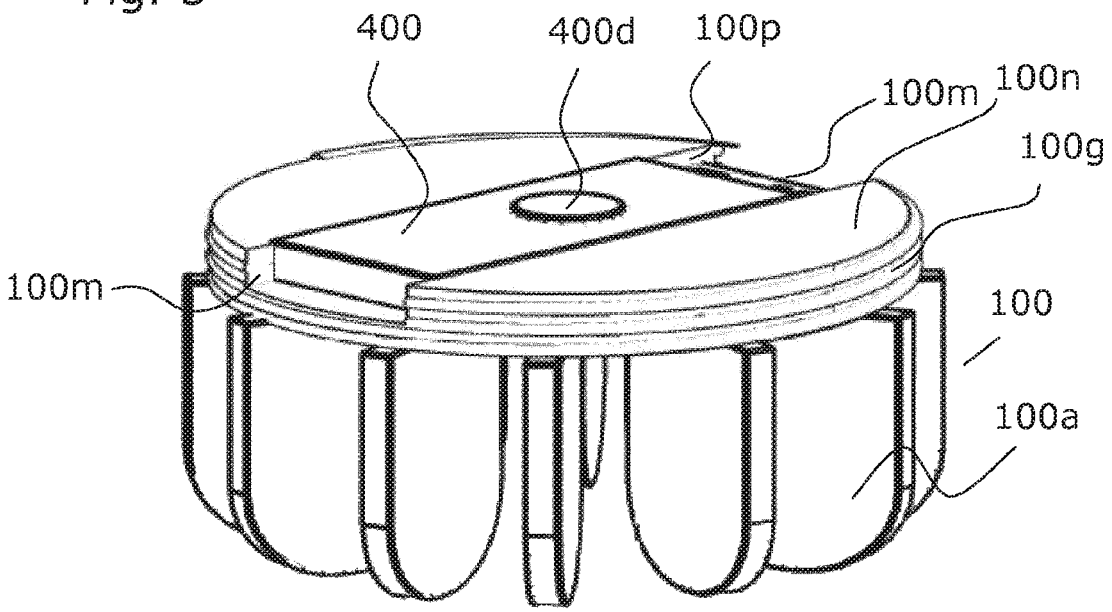

LIGHTING SYSTEM

This application is a U.S. national-stage application, under 35 U.S.C. § 371, of PCT International Patent Application No. PCT/EP2016/078872, which claims priority from Application 10 2015 120 490.8 filed on Nov. 26, 2015 in Germany. The entire contents of these applications are incorporated herein by reference in their entirety.

The present invention relates to a lighting system, in particular in the form of a lamp, having at least one cooling element (10, 100).

The use of LED modules in lighting systems is known for example from EP 1 590 996 B1, wherein in this a socket is fixed to the cooling elements in which the LED modules can be used. The disadvantage of this is that sockets are in particular needed for LED holders, and this makes the production process both more difficult and more expensive.

A similar lighting system is known from EP 2719938 A1, US2010/0025721 A1, DE 20 2008 011 979 U1 and US2011/0176308 A1. The disadvantage of these systems is that the LED modules are supplied with electrical energy by means of expensive busbars or contact elements, etc.

The object of the present invention is to provide a lighting system in which the LED modules used are easy to replace and are also supplied with electrical energy with minimal effort and cooled in a simple manner.

This object may be achieved by means of a lighting system having various features described herein and as may be found in various ones of the accompanying claims.

The invention is advantageously characterised in that LED modules are able to be inserted into or used in a first module holder, wherein the first module holder is cooled by the cooling element itself so no additional socket is needed to fix the LED module. The holder of the at least one LED module is formed by a recess in the surface of the cooling element, which for example can be produced by milling, grinding or during the cooling element casting process.

The recess can be formed by a groove. This can either be U-shaped in cross-section, wherein the lateral border walls do not form an indentation for the elongated sides of the LED module and the module is pushed against the base wall by an additional part such that there is a good conduction of heat from the LED module to the cooling element during operation. The lateral border walls can also have indentations. These can be designed to be diagonal and therefore to form a dovetail guide or formed according to a T-groove such that the LED module can only be inserted into the recess in the cooling element from the side. It is advantageous if the indentations are designed such that the LED module can initially be inserted into an anterior first region of the recess without clearance, thereby decreasing the cross-section of the recess or the indentations such that a contact pressure is generated on the LED module, by means of which the LED module is pushed against the base wall of the recess or groove.

The supply of the at least one LED module is by means of electrical contacts that are arranged on the LED module and which come into contact with electrical contacts in the lighting system when the LED module is fully inserted or pushed into the recess. In a particularly preferred embodiment of the invention, a supply module is provided which is inserted or arranged into the same recess or an additional second recess of the cooling element, wherein the supply module has electrical contacts that are arranged such that they come into contact with the electrical contacts in the LED module when said module is fully inserted or pushed in. In this way, the electrical contacts can be arranged on or in the front faces of the LED and supply module. It is, however, equally possible to arrange the electrical contacts on sections of the wall that are arranged in parallel to or at an angle to the base wall of the recess. The LED module and the supply module can for example overlap in areas, wherein the interacting electrical contacts are arranged on the overlapping surfaces that face one another. It is necessary to ensure that the shape and height of the contacts are designed such that there is good contact and a sufficiently large contact surface that there are no significant contact resistances.

The shape of the recess can be designed such that the LED module can only be inserted into the recess of the cooling element with a specific orientation so false polarity cannot occur. The longitudinal extension of the recess and the LED module can therefore have areas with different cross-sectional shapes which are designed that the LED module can only be inserted into the recess in one orientation. For example, the LED module can be designed to be broader on one front face that the region of the recess in which the narrower region of the LED module is arranged when it is inserted to which the at least one LED is fixed and which is first inserted or pushed into the recess.

Like the LED module, the supply module can also be secured against incorrect insertion into the module as described above.

The invention is described in greater detail below by means of exemplary embodiments.

Figures 1A, 1B, 1C:
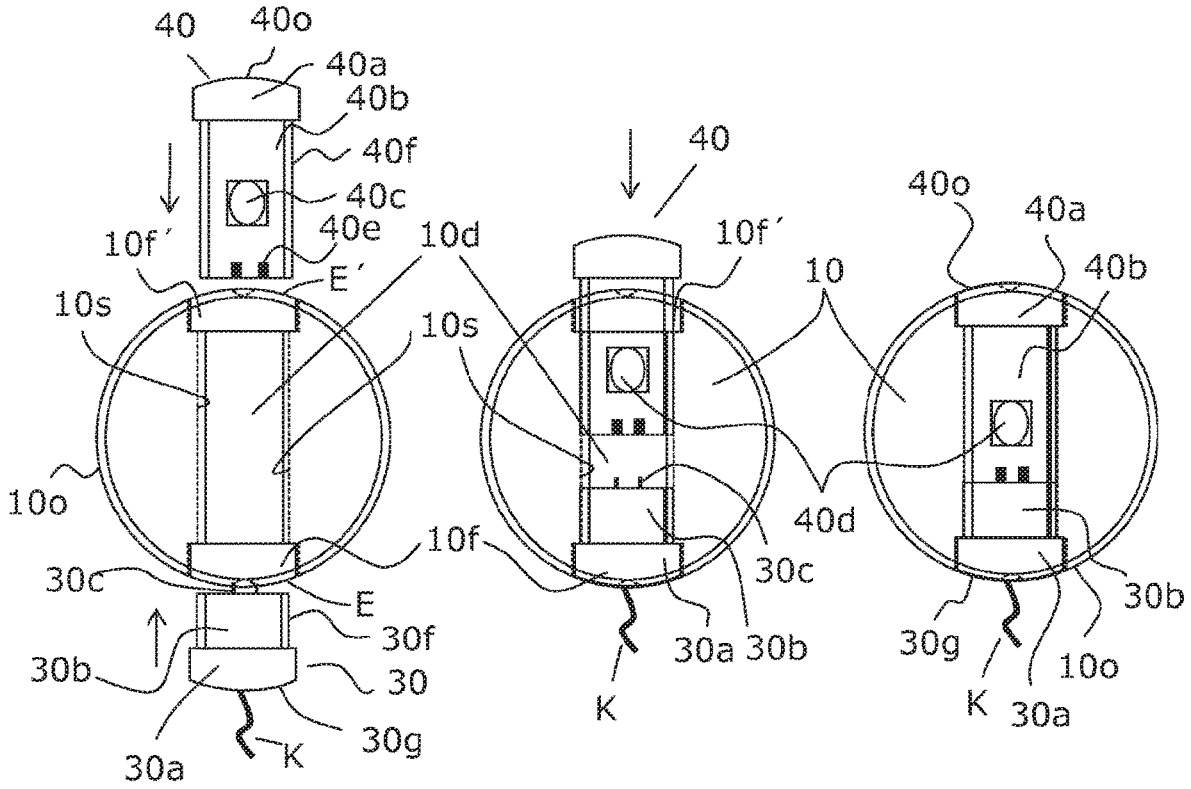
Figure 2:
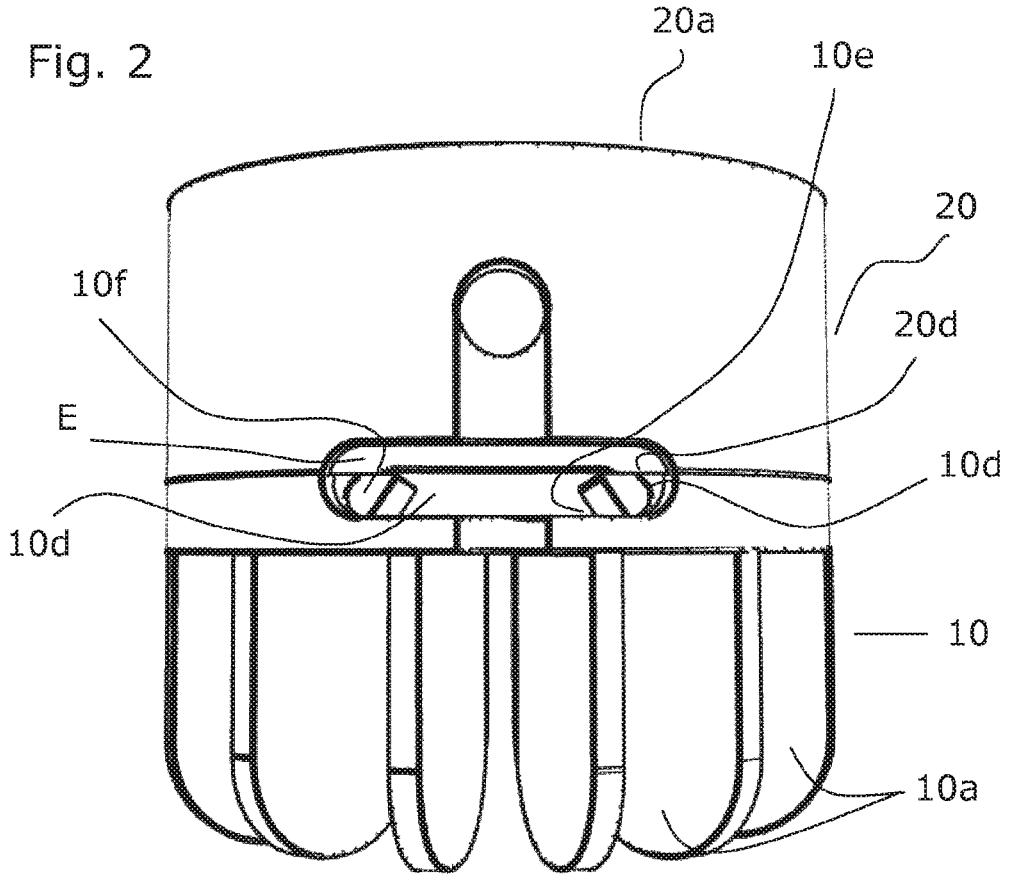
Figure 3:
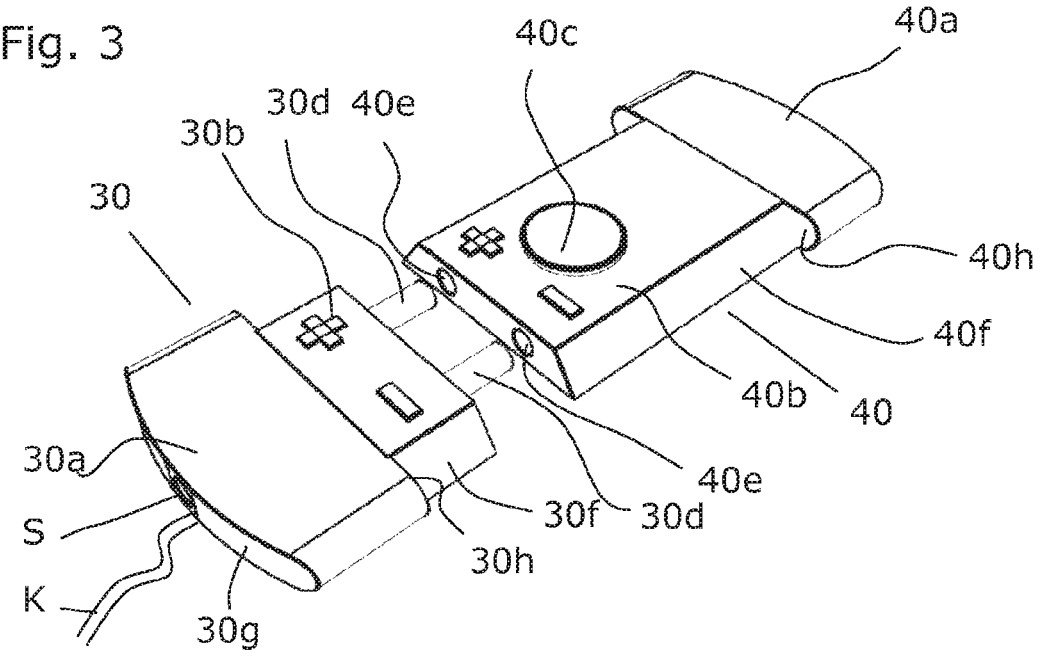
Figure 7:
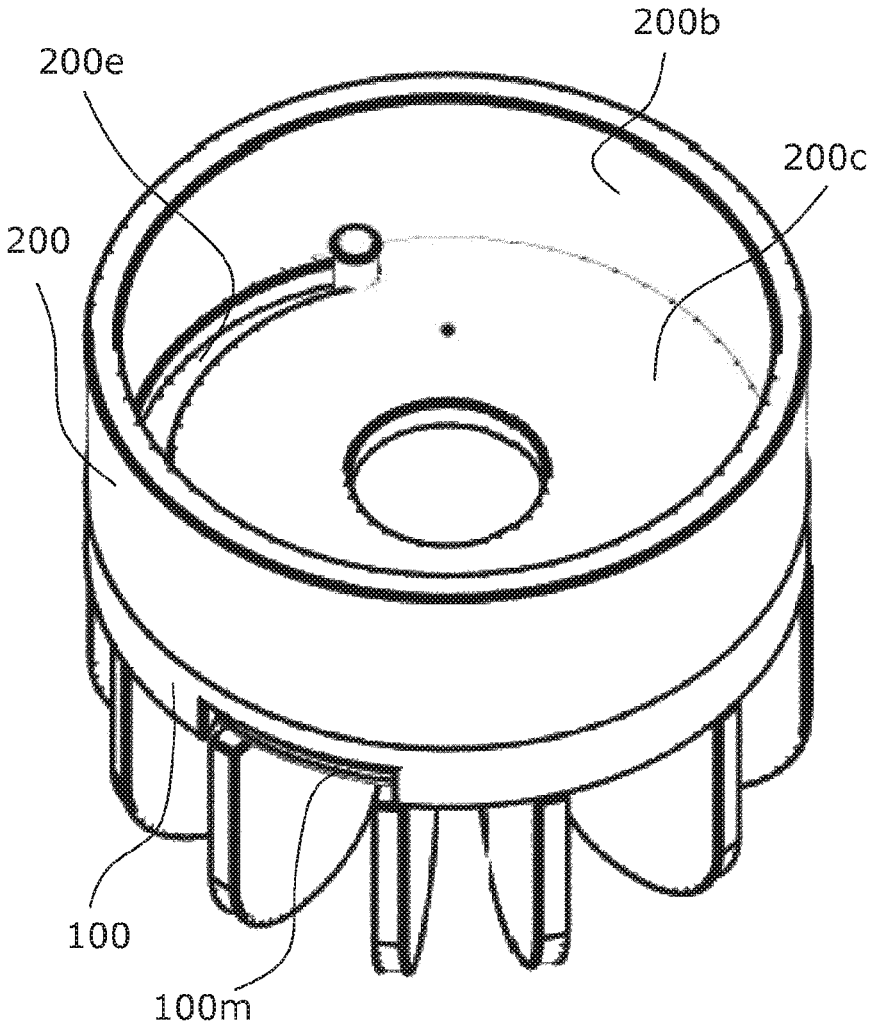
Figure 8A:
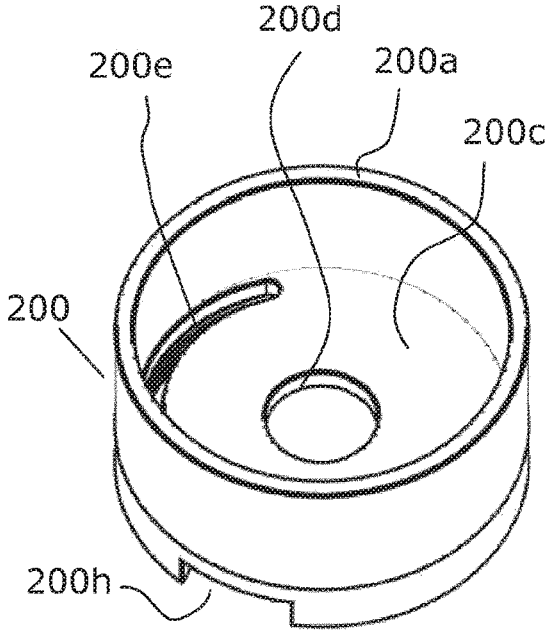
Figure 8B:
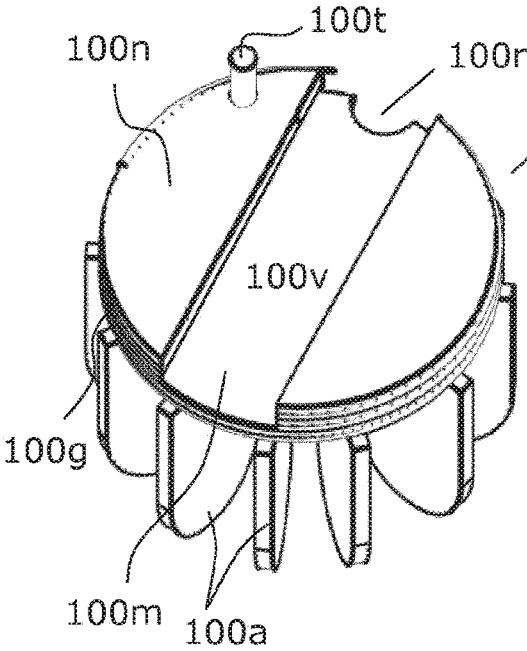

FIG. 1: perspective view of a first possible embodiment of the lighting system according to the invention;

FIGS. 1*a-c*: plan view of a cooling element according to FIG. 1 with an LED module and supply module in various insertion positions;

FIG. 2: side view of the lighting system according to FIG. 1;

FIG. 3: perspective view of the LED module and the associated supply module;

FIG. 4: perspective view of an LED module and associated supply module according to a second possible embodiment;

FIG. 5: alternative lighting system consisting of a cooling element and screw-on part;

FIG. 6: lighting system according to FIG. 5;

FIG. 7: further possible embodiment of a lighting system according to the invention with a screw-on part that is only rotatable about a specific angular range relative to the cooling element;

FIG. 8*a*: screw-on part for a lighting system according to FIG. 7;

FIG. 8*b*: cooling element of the lighting system according to FIGS. 7 and 8*a;*

Figure 9A:
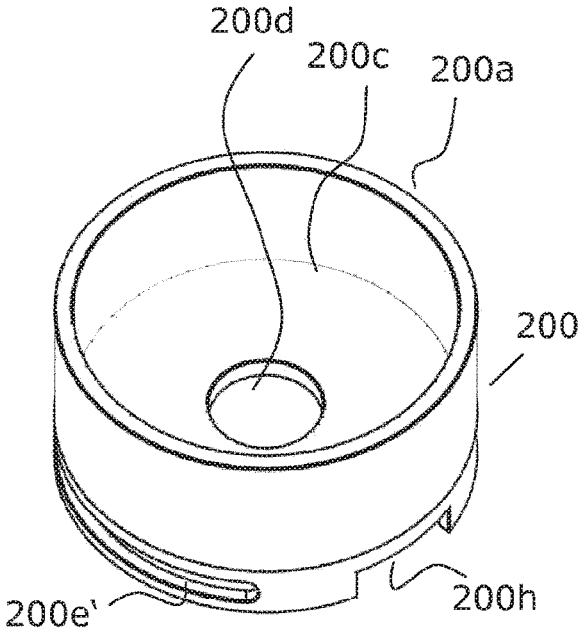
Figure 9B:
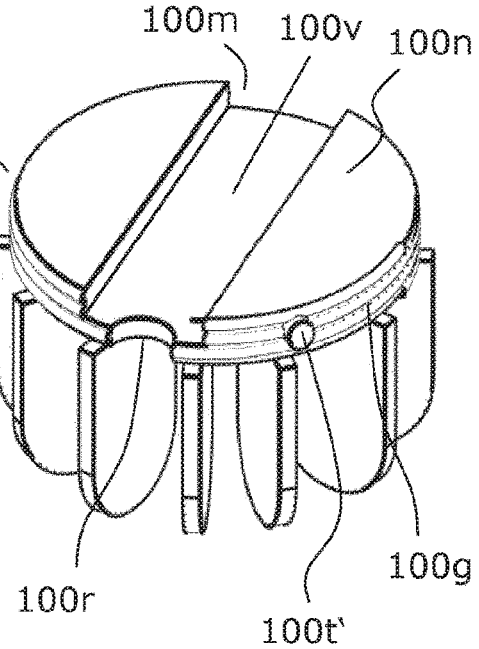
Figure 10:
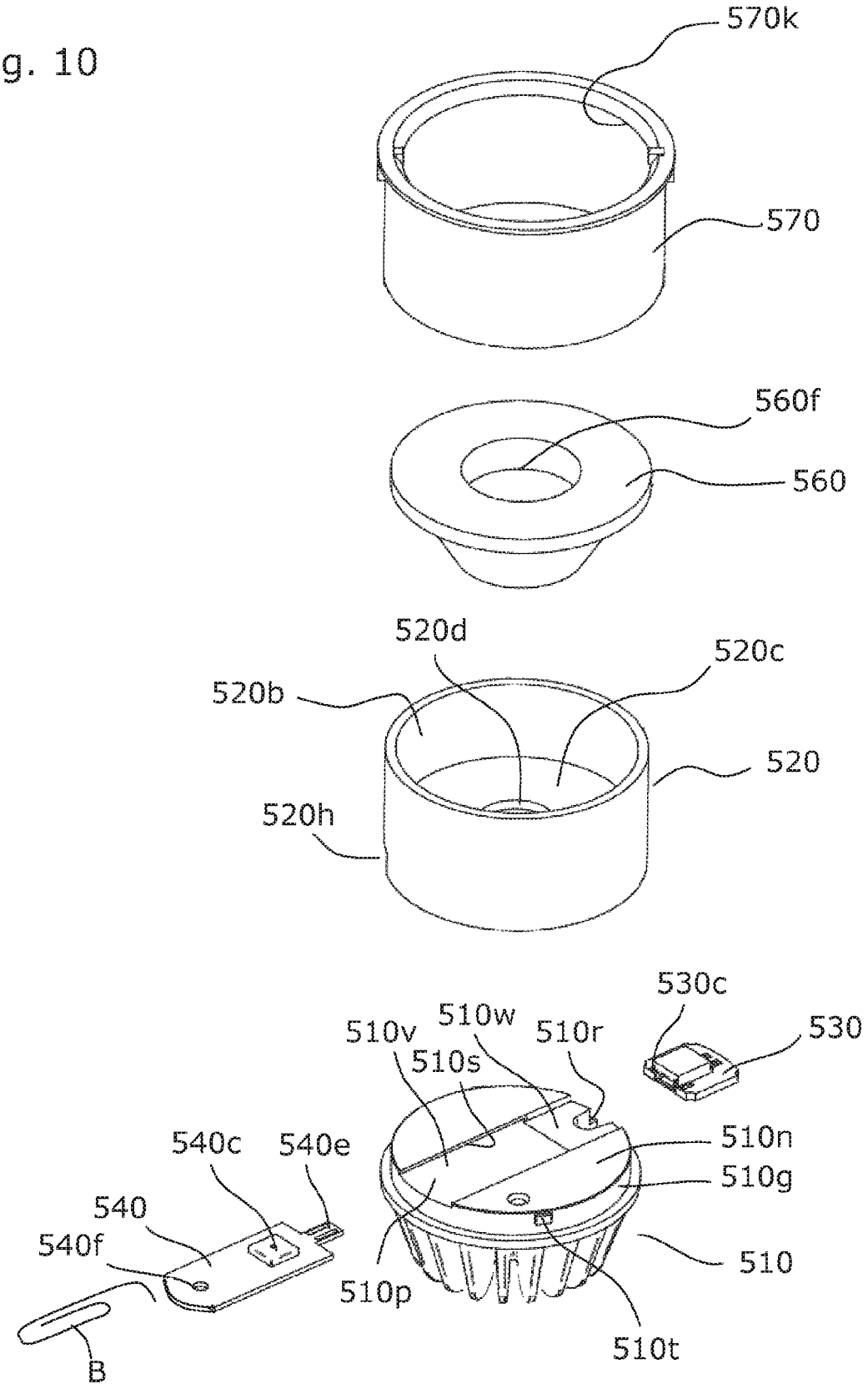
Figure 11:
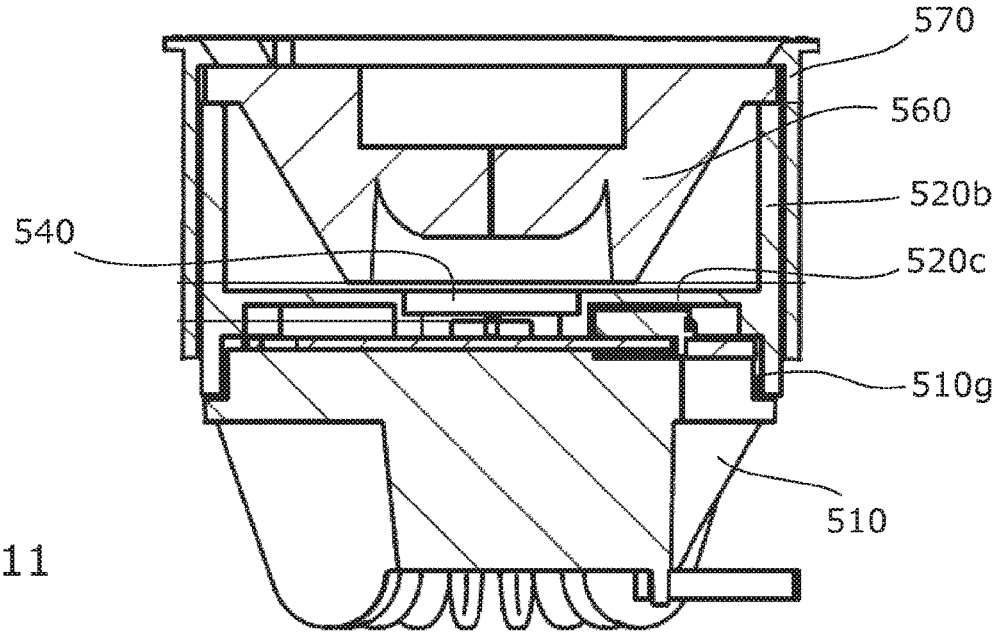
Figure 12:
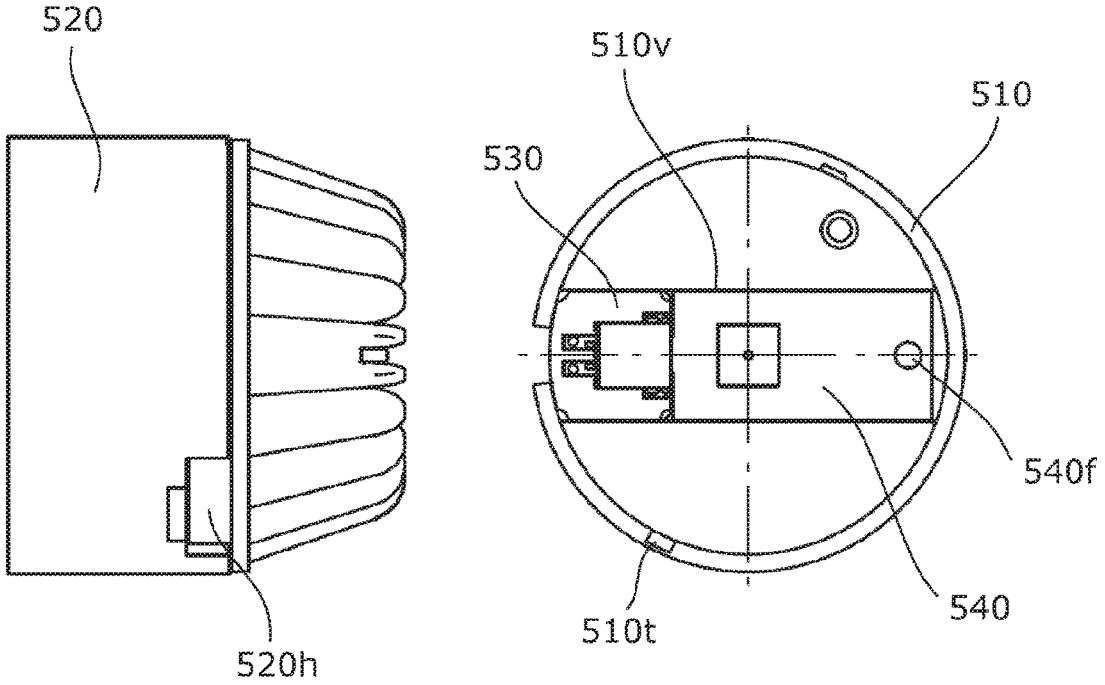

FIGS. 9*a* and 9*b*: alternative lighting system with twisting limitation of the screw-on part relative to the cooling element;

FIGS. 10 to 12: further possible lighting system consisting of a cooling element, an upper part that can be screwed onto the cooling element in which a reflector can be used and is held in a secure manner by means of a sleeve-shaped part that can be fixed to the upper part.

FIG. 1 shows a first possible embodiment of the lighting system according to the invention in the form of a lamp. The lamp has a cooling element 10 and an upper part 20 fixed to it. The cooling element 10 has a recess 10*d* on its upper side 10*b*, into which recess an LED module 40 and a supply module 30 can be inserted. Together, the cooling element 10 and the part 20 form lateral insertion openings E and E' in which the LED module 40 and the supply module 30 can be inserted into the recess of the cooling element 10 from the side. The lower side of the cooling element 10 has cooling fins 10*a*. When the modules have been inserted, both modules 30, 40 are aligned with the outer wall 10*o* of the cooling element 10 and the upper part 20. The upper part 20 has a cylindrical wall 10*b* with a front face 20*a*. The upper part 20 can be connected to the cooling element 10 by means of a plug connection and potential grid connections. It is also possible, however, for the upper part 20 and the cooling element 10 to be screwed to one another. Optics and/or a reflector (not shown) which can or is for example be arranged in part 20 and has a window-like opening, through which the light source 40 C in the form of one or more LEDs shines. The optics can for example be a lens or a lens system. The window-like opening is designed such that the surface 10*b* of the cooling element 10 and the two modules 30, 40 cannot be seen from the outside.

FIGS. 1*a* to 1*c* show the insertion of the two modules 30, 40 into the lamp consisting of the cooling element 10 and the upper part 20. The cooling element 10 has a recess 10*d* that is formed by a dovetail groove. Of course it is equally possible to use another indented groove such as a T-groove. Together with its diagonal lateral walls 10*e*, the dovetail groove 10*d* forms indents 10*s* that interact with the diagonal side wall sections 30*f*, 40*f* of the modules 30, 40. Larger recesses 10*f*, 10*f* are incorporated in the region of the insertion openings E, E' into which the head areas 30*a*, 40*a* of the two modules 30, 40 are placed for storage as shown in FIGS. 1*b* and 1*c*. Only when both modules 30, 40 are completely inserted into the cooling element 10 and the recesses of this 10*d* and 10*f*, 10*f* are the LED modules connected to one another by means of the electrical contacts 30*c* and 40*e*. The LED(s) 40*d* are clearly positioned relative to the cooling element 10 or the lamp due to the design of the modules 30, 40 and the corresponding recesses 10*d*, 10*f*, 10*f*. The recesses 10*f* and 10*f* can be designed to be identical such that the two modules 30, 40 can be interchanged with one another and inserted into the recesses of the cooling element 10.

FIG. 2 shows a lateral view of the lamp, consisting of a cooling element 10 and an upper part 20. The window-like opening E is arranged in front of the indented groove 10*d*, which can in particular preferably be designed as a dovetail guide, and by its dimensions is held such that the head areas 30*a*, 40*a* can be inserted into the opening E, E'.

FIG. 3 shows the perspective representation of the two modules 30, 40. The supply module 30 has a head area 30*a* that has a rounded front face 30*g*. The head area 30*a* is attached to the area 30*b* with a smaller cross-section, the side walls 30*f* of which are arranged diagonally to the surface 10*b* of the cooling element 10. Two electrical contacts 30*c* can be found on the front face of the area 30*b*, which contacts interact with sockets 40*e* of the LED module 40 and engage to create an electrical contact. The smaller cross-section of the area 30*b* means the surface 30*h* is pushed against the front wall 10*f* on insertion into the cooling element 10 (see FIG. 2), resulting in the supply module 30 not being able to be pushed any further into the cooling element 10. The LED module also has a head area 40*a* to which the area 40*b* is attached. Like area 30*b* of the supply module 30, the area 40*b* has diagonally longitudinal sides 40*f* that interact with the dovetail groove 10*d* of the cooling element 10 and cannot fall out towards the front side (front face 20*a*) as a result of the modules 30, 40. The light source is arranged on the upper side of the area 40*b* in the form of one or more LEDs 40*c*. The head area 40*a* and its protruding wall 40*h* form a stop which can be used to reach the module 40 on the front wall 10*f* of the cooling element 10. The supply module 30 can be/is connected to a supply line or upstream electronics by means of a cable K. FIG. 3 shows an insertion hole S which serves to ensure the simple extraction of the LED module 40 using a sharp tool (e.g. a paper clip).

FIG. 4 shows an alternative embodiment of the modules 30' and 40', wherein the modules differ from one another in that when inserted they overlap in areas 30*b*' and 40*b*' according to FIG. 1*c* such that the contacts 30*c*' and 40*e*' come into electrical contact with one another. In order to do this, the cross-section of the areas 30*b*' and 40*b*' is designed to be smaller than the cross-section 40*b*' of the LED module 40. The supply module 30' can be/is connected to a supply line or upstream electronics by means of a cable K. As shown in FIG. 3, in FIG. 4 you can see an insertion lock S' for the extraction of the LED module 40. In addition to this, exemplary contact springs are arranged on the supply module which push on contact surfaces in the LED module thereby ensuring an electrical connection.

FIG. 5 shows an alternative embodiment of the lamp having a cooling element 100 and an upper part 200. The inner thread 200*g* of the upper part 200 is screwed onto the thread 100*g* of the cooling element 100, wherein the threads 100*g* and 200*g* are designed such that the recess 200*h* is flush with the groove 100*p*, 100*m* which is incorporated into the surface 100*n* of the cooling element 100. The underside of the cooling element in turn has cooling fins 100*a*. The height of the LED module 400 is adapted to the depth of the groove 100*p* such that the upper side of the LED module 400 easily protrudes over the upper side 100*n* of the cooling element. As can be seen from FIG. 6, the upper part 200 has a horizontal wall 200*c* which has a central recess 200*d*. When it is fully screwed together, the underside of the wall 200*c*, the upper part 200 pushes the LED module 400 against the base surface of the groove 100*p* such that good heat transfer between the LED module 400 and the cooling element 100. The central recess 200*d* is arranged above the LED 400*c* such that the LED can shine through the window-like recess 200*d*. The upper part 200 has a lateral recess 200*h* which can be rotated in front of the groove 100*p* by loosening the screws (rotating the upper part 200 in an anticlockwise direction). Partially releasing the screws increases the contact pressure so the LED module 400 and any supply module can be removed from the lamp from the side. The upper part 200 with its cylindrical wall 200*b* can be used as a reflector. It is also possible, however, for an additional reflector, in particular a conically formed reflector, and/or optics to be used in the upper part 200.

FIG. 6 shows both parts 100, 200 separate from one another. A recess 100*r* is incorporated into one end of the base wall of the groove 100*p* which serves to ensure that the cable K, K' of the supply module can be fed out. In contrast to the modules 30, 40 shown in FIGS. 3 and 4, the LED and the supply module for the lamps shown in FIGS. 4-6 have head areas 30*a*, 40*a* with different cross-sections. They can have a constant width over the longitudinal extension which is slightly smaller than the width of the groove 100*p*.

It is also possible for the head area 30*a* of the supply module 30, in particular the cross-sectional shape of this, to be designed to be different to the head area 40*a* of the LED module 40. In this embodiment, the recesses 10*f*, 10*f* also have to be adapted to the various cross-sectional shapes of the two head areas 30*a*, 40*a* such that the two modules 30, 40*a* cannot be interchanged and two LED modules also cannot be inserted at the same time.

FIG. 7 shows a perspective view of a further possible lamp according to the invention that consists of the cooling element 100 shown in FIG. 8*b* and the upper part 200 shown in FIG. 8*a*. The upper part 200 is screwed onto the thread 100*g* of the cooling element 100, whereupon the bolts 100*t* are inserted through the groove 200*e* of the upper part 200 through a bore provided in the surface of the cooling element 100*n*, which bore optionally has an inner thread and is fixed there securely, in particular by means of adhesion or screwing. The bolts 100*t* serve as security to ensure that the upper part 200 can no longer fully be unscrewed from the cooling element 100. The bolts 100*t* can be used to rotate the upper part 200 by part of a rotation relative to the cooling element 100 resulting in the upper part 200, the module in the groove 100*v* in the form of the LED module and the supply module no longer being pushed against the base of the groove 100*m* by the base wall 200*c* and them therefore being able to be removed from the cooling element and therefore replaced.

FIGS. 9*a* and 9*b* show a further alternative embodiment in which the bolts 100*t*' that limit the angle of rotation engage in a window-like groove 200*e*' of the upper part 200. These bolts 100*t*' can only be screwed, adhered or compressed after the upper part 200 has been fully screwed to the cooling element 100. Otherwise the embodiments shown in FIGS. 8*a*, 8*b*, 9*a* and 9*b* are functionally identical to the embodiment shown in FIGS. 5 and 6.

FIGS. 10 to 12 show a further possible lighting system consisting of a cooling element 510 and an upper part 520 which can be screwed onto the cooling element 510 in which a reflector 560 can be used. The reflector 560 is held in a secure position by means of a sleeve-shaped part 570 which can be screwed onto the upper part 520. In order to do this, the part 570 has a collar 570*k* which points inwards such that the window-like opening 570 of the part 570 is smaller than the reflector 560 such that the reflector is held in a secure manner when the part 570 is fixed to the upper part 520 by means of the collar 570*k* in the upper part 520. It is also possible, however, that in addition the reflector 560 can also be pushed against the upper part 520, in particular the wall 520*c* of said upper part, such that the reflector 560 is firmly fixed in the lighting system. The cooling element 510 has a fundamentally similar structure or is designed like the cooling elements in the embodiments described above. The lateral walls 510*s* or the recess 510*p* can also be designed with or without an indent. If they are designed without an indent, in other words vertical to the base wall 510*v*, the LED module 540 can also be inserted into the recess from above provided the upper part 520 is fully unscrewed or removed from the cooling element. In a preferred variant, however, the upper part 520 has a lateral recess 520*h*. By rotating the upper part 520 screwed onto the cooling element 510, it is possible to align the recess 520*h* flush with the recess or groove 510*p* such that the LED module 540 can be inserted from the side through the recess 520*h* into the groove 510*p* or the lighting system. An anti-rotation device 510*t* as shown and described in the exemplary embodiments according to FIGS. 7 and 8*a* to 9*b* is also provided, wherein the pin 510*t* limits the possible range of the angles of rotation of the cooling element 510 relative to the upper part 520, for example to a quarter rotation. Once the LED module 540 has been fully pushed or inserted into the recess 510*p* of the cooling element 510 and the electrical contacts 540*e* of said module are in electrical contact with the contacts 530*c* of the supply module 530 inserted into a recess 510*w* adjacent to the recess 510*p*, the upper part 520 can once again be screwed tightly to the cooling element 510, resulting in the LED module 540 being pushed against the base wall 510*v* of the recess 510*p*.

The depth and length of the recess 510*w* for the supply module 530 are differently designed to the recess 510*p* for the LED module 540, so the modules 530, 540 can only be used in one direction and arrangement in the lighting system. It is however also possible for the depth of both recesses to be designed to be the same.

The LED module 540 has an in particular window-like recess on the side which faces the contacts 540*e* into which a tool such as in the form of the thin wire of a paper clip B can be inserted in order to remove the LED module 540 from the recess 510*p*.

What is claimed is:

1. A lighting system, including:

at least one cooling element, wherein the at least one cooling element comprises at least one first recess, in the form of a groove that forms a first module holder for at least one light-emitting diode (LED) module, and an upper part configured to be fixed or locked to the at least one cooling element, wherein the upper part comprises optics and/or a reflector configured to be arranged in or inserted in the upper part, and wherein the upper part is cylindrical or conical, has a lateral recess, and is configured to be screwed onto the at least one cooling element, wherein the at least one LED module lies in or is configured to be inserted into the at least one first recess, wherein the at least one first recess comprises a base wall and limiting lateral walls, and wherein the at least one LED module which lies in or is configured to be pushed into the at least one first recess is configured to be pushed in a direction of the base wall by at least one of the limiting lateral walls or by the upper part.

2. The lighting system according to claim 1, wherein the reflector has a window-like opening.

3. The lighting system according to claim 1, wherein the at least one first recess is formed by an opening or milling groove in a surface of the cooling element.

4. The lighting system according to claim 1, wherein the limiting lateral walls of the at least one first recess form opposing linear guides configured to interact with longitudinal sides of the at least one LED module, wherein the linear guides are formed by at least one undercut in a surface of the cooling element.

5. The lighting system according to claim 1, further including a supply module configured to be arranged in the lighting system and configured to connect the at least one LED module to a supply source or connection lines in the lighting system.

6. The lighting system according to claim 1, wherein the cooling element also forms part of the housing of the lighting system.

7. The lighting system according to claim 1, wherein the at least one first recess is incorporated into the cooling element by a process selected from the group consisting of milling and grinding or is formed in at least one side of the cooling element during a cooling element casting process.

8. The lighting system according to claim 1, wherein the at least one recess is designed such that the at least one LED module is permitted to only be fully inserted or pushed into the at least one recess in one direction.

9. The lighting system according to claim 1, wherein the at least one recess has a first area and a second area, wherein a width and/or height and/or cross-sectional area of the second area is designed to be greater than the first area and forms an insertion opening.

10. The lighting system according to claim 5, wherein electrical contacts of the at least one LED module which has been fully pushed or inserted into the recess are in electrical contact with corresponding electrical contacts of the supply module.

11. The lighting system according to claim 5, further including a further module holder configured to receive the supply module, wherein the first and further module holders are connected to one another such that the LED and supply modules of these module holders are in electrical contact with one another when the LED and supply modules are fully inserted.

12. The lighting system according to claim 1, further comprising at least one supply module, wherein a respective LED module of the at least one LED module has a corresponding supply module of the at least one supply module, or wherein one supply module of the at least one supply module supplies several LED modules of the at least one LED module and is in electrical contact with these several LED modules.

13. The lighting system according to claim 12, wherein at least one supply module is connected to upstream electronics or lighting system connections by means of electrical connections, or wherein the at least one supply module has connections to external connection lines.

14. The lighting system according to claim 11, wherein the first and further module holders are formed by recesses in the at least one cooling element, wherein the recesses comprise limiting lateral walls formed as linear guides, wherein the linear guides are in parallel and flush with one another or are arranged at an angle relative to one another.

15. The lighting system according to any one of claim 12, wherein an LED module of the at least one LED module is configured to, at least in part, be pushed out of its module holder by its respective supply module of the at least one supply module, wherein part of the LED module is arranged to be gripped with the fingers of one hand and thus is fully removable from its module holder manually or using a tool.

16. The lighting system according to claim 14, wherein the linear guides for the module holders for the at least one LED module and the at least one supply module are formed, respectively, by an indented groove in the form of a single dovetail guide.

17. The lighting system according to claim 1, wherein the at least one LED module is fully inserted into the module holder and has an area which protrudes 2 to 11 mm from a lateral wall of the at least one cooling element of the lighting system, wherein this protruding area is configured to be gripped with the fingers of one hand, and wherein the at least one LED module is thus configured to be removed from the module holder without using a tool.

18. The lighting system according to claim 1, further including a lateral window-like opening configured to allow the at least one LED module to be inserted into the at least one first recess.

19. The lighting system according to claim 1, wherein the at least one LED module, when fully inserted into the first module holder, has an area that forms an outer wall which is flush with a lateral wall of the at least one cooling element or protrudes out beyond the lateral wall at least in some areas, wherein the at least one LED module together with an outer side of the at least one LED module forms or has a forwards or backwards projection, wherein the forwards or backwards projection is configured to permit the at least one LED module to be gripped using fingers of one hand, wherein the at least one LED module is thereby removable from the module holder without using a tool.

20. The lighting system according to claim 5, wherein the supply module is disposed in a further module holder or is fixed to the lighting system and is configured to exert a force on the at least one LED module that is fully inserted into the first module holder, wherein the force pushes the at least one LED module against a surface of the at least one cooling element.

21. The lighting system according to claim 5, wherein the upper part includes a wall configured to push against the at least one LED module and/or the supply module, which in turn pushes the at least one LED module and/or the supply module against the base wall of the at least one first recess-when the upper part is screwed onto the at least one cooling element.

22. The lighting system according to claim 21, wherein the upper part is configured to be secured by a device to prevent unscrewing, wherein the device to prevent unscrewing comprises a projection or bolt configured to engage in a groove of the upper part before full unscrewing, such that the upper part and the at least one cooling element are only permitted to be rotated relative to one another by means of a thread within a limited range of angles between 60° and 180.

23. The lighting system according to claim 21, further including a reflector configured to be inserted into the upper part, wherein the reflector is configured to be held in the upper part in a secure manner by means of a sleeve-shaped part that is configured to be screwably fixed on the upper part and to be pushed against the wall.

24. A light-emitting diode (LED) module configured to serve as the at least one LED module of the lighting system according to claim 1, the LED module comprising electrical contact surfaces which are configured to interact with electrical contacts of a supply module and to come into contact with said electrical contacts of the supply module when the lighting system according to claim 1 is assembled.

25. The LED module according to claim 24, further comprising a base body on which at least one LED is arranged on one side; and at least one electrical contact or plug configured to connect the LED module to one or more voltage source(s) and/or to at least one control line or to the supply module.

26. The LED module according to claim 24, further comprising a recess for removal of the LED module from the lighting system, wherein the recess is configured to permit a tool to be introduced.

27. A supply module for use with the lighting system according to claim 1, the supply module comprising at least one electrical contact or plug configured to be used to create an electrical connection to the at least one LED module of the lighting system of claim 1.

28. The lighting system according to claim 1, wherein the lateral recess of the upper part is flush with the groove of the at least one cooling element when the upper part is fixed or locked onto the at least one cooling element.

* * * * *